US005117569A

United States Patent [19]

Bean

[11] Patent Number: 5,117,569

[45] Date of Patent: Jun. 2, 1992

[54] GREETING CARD

[76] Inventor: Revonna L. Bean, 6508 Kincannon Ct., Knoxville, Tenn. 37918

[21] Appl. No.: 568,260

[22] Filed: Aug. 15, 1990

[51] Int. Cl.[5] ..... G09F 1/00

[52] U.S. Cl. ..... 40/124.1; 434/368

[58] Field of Search ..... 40/124.1, 427, 577, 40/580; 281/15.1; 283/117; 446/147, 321; 434/368, 373, 269; 229/92.8

[56] References Cited

U.S. PATENT DOCUMENTS

| | | | |
|---|---|---|---|
| 1,899,518 | 2/1933 | Moore . | |
| 2,001,312 | 1/1934 | O'Connell . | |
| 2,173,939 | 5/1937 | Hall . | |
| 2,240,072 | 5/1939 | Hodgdon et al. . | |
| 2,499,731 | 1/1945 | Derington . | |
| 2,565,553 | 11/1948 | Foley . | |
| 2,725,651 | 12/1955 | Spear | 411/124.1 |
| 2,984,920 | 5/1961 | Acosta et al. | 40/124.1 |
| 3,492,743 | 2/1970 | Schmidt | 281/15.1 X |
| 4,034,494 | 7/1977 | Lane . | |
| 4,055,690 | 10/1977 | Patterson | 40/124.1 X |
| 4,182,060 | 1/1990 | Longenecker . | |
| 4,310,832 | 1/1982 | Fitzgerald | 40/577 X |
| 4,512,581 | 4/1985 | Levine | 434/177 X |
| 4,622,768 | 11/1986 | Moreau | 40/124.1 |
| 4,826,211 | 5/1989 | Sinnott et al. | 40/124.1 X |
| 4,890,402 | 1/1990 | Carroll | 40/124.1 X |
| 4,951,404 | 8/1990 | Lithwick | 40/124.1 |

FOREIGN PATENT DOCUMENTS

| | | |
|---|---|---|
| 568884 | 12/1960 | Belgium . |
| 1442239 | 5/1966 | France . |
| 460715 | 12/1950 | Italy . |

*Primary Examiner*—Laurie K. Cranmer
*Assistant Examiner*—Brian K. Green
*Attorney, Agent, or Firm*—Luedeka, Hodges, Neely & Graham

[57] ABSTRACT

The specification discloses a new and improved greeting card comprising a first translucent panel having indicia thereon and a second panel connected to the first panel and with an opening which defines an image thereon. The translucency of the first panel and its arrangement relative to the second panel is such that upon disposition of the first panel closely adjacent to the second panel in an overlay fashion, the image on the second panel is relatively indistinctly visible through the first panel in conjunction with the indicia on the first panel to enhance and supplement the experience associated with viewing the indicia.

6 Claims, 2 Drawing Sheets

GREETING CARD

The present invention relates to greeting cards and like items and particularly relates to a greeting card which provides a visual arrangement that supplements and enhances the experience associated with reading the message of the card.

Conventional greeting cards typically have a relatively simple construction consisting of a single piece of relatively stiff paper folded over upon itself to provide front and back panels. The outside is usually decorated in some fashion appropriate to the message of the card which is generally the subject of writing or other indicia located inside the card on the front of the back panel. Some cards also include relatively complicated and expensive to make fold-out portions or the like which are intended to entertain the recipient or provide an experience for the recipient in addition to merely reading or viewing the indicia on the inside. There is a need for a greeting card that supplements and enhances the experience associated with reading the message of the card and which avoids the complexity and cost associated with prior cards containing features that supplement or enhance the reader's experience.

Accordingly, one object of the invention is to provide a greeting card.

Another object of the invention is to provide a greeting card that has a relatively simple and inexpensive construction.

An additional object of the invention is to provide a greeting card that may be produced from readily available materials.

A further object to the invention is to provide a greeting card that resembles a conventional card in simplicity and construction, but which is provided with features that enhance and supplement the experience associated with reading the message or viewing the indicia on the inside of the card.

These and other objects and advantages are achieved in the greeting card of the present invention which, in general, comprises a first panel that is translucent to the transmission of light and which has indicia provided thereon. A second panel is connected to the first panel and includes means defining an image thereon. The translucency of the first panel and its arrangement relative to second panel is such that upon disposition of the first panel closely adjacent to the second panel in an overlay fashion, the image on the second panel is relatively indistinctly visible through the first panel in conjunction with the indicia on the first panel. Preferably, the indicia is a written message having a theme and the image has a connotation that is generally associated with the theme to supplement and enhance the experience associated with reading the message.

In a preferred embodiment, the card of the invention includes front and back panels that are formed of a single sheet of relatively stiff paper folded over upon itself, wherein the fold line defines the juncture between the front and back panels. The card further includes a middle or interior panel that is translucent to the transmission of light and which contains indicia or wording so as to provide a message thereon. The interior panel is joined to the front and back panels adjacent the fold line between the panels. In this embodiment, the back panel includes means defining an image thereon. For example, the back panel may be constructed of relatively opaque paper and contain a cutout in the form of the image to thereby transmit light in a manner so as to define an appearance corresponding to an image having a connotation which is associated with the theme. Or, the back panel may be provided by a relatively stiff, clear paper such as an acetate film or plastic, for example, and contain darkened areas thereon configured to define the appearance of the image. The translucency of the middle panel and its arrangement relative to the back panel is such that upon disposition of the middle panel closely adjacent to the back panel in an overlay fashion, the image that is defined on the back panel is relatively indistinctly visible through the middle panel in conjunction with the message on the middle panel to enhance and supplement the experience of the reader of the message.

The above and other features and advantages of the invention will now be further described with reference to the drawings that accompany this specification, in which.

Figure 1:
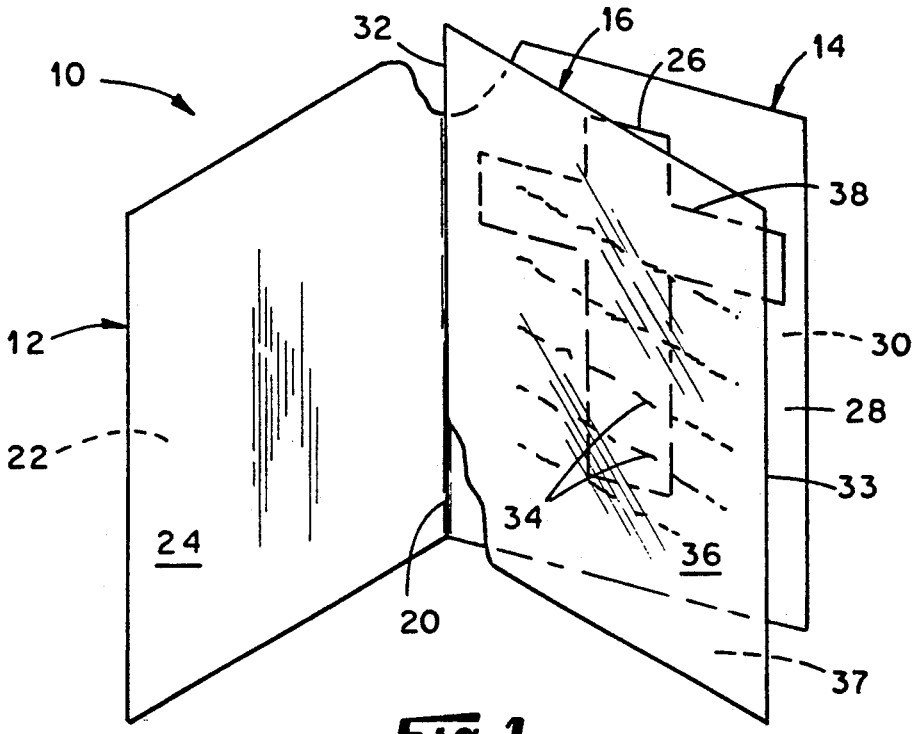
FIG. 1 is a perspective view of a greeting card in accordance with one embodiment of the invention with parts broken away to show details of construction.

With reference now to the drawings in which like reference characters designate like or similar parts throughout the several views, there is shown in FIG. 1 a greeting 10 illustrating one embodiment of the present invention. The card 10 of FIG. 1 includes a front panel 12, a back panel 14 and a middle panel 16. The front and back panels 12 and 14 in this embodiment are made from a single sheet of paper of a type and grade so as to be substantially opaque to the transmission of light therethrough. For example, the panels 12 and 14 may be provided by 80 pound cover stock paper such as the 80 pound paper sold under the trademark FRENCH SPECKLETONE by the French Paper Company of Niles, Michigan, the 80 pound paper sold under the trademark CURTIS & WEEDWEAVE by James River Co. of South Hampton, Pa., or the 80 pound paper sold under the trademark CLASSIC LAID by the Neenah Paper Co. of Neenah, Wis. The panels 12 and 14 are made by folding the paper along a midline to provide a fold or edge 20, the outside of which defines the spine of the card 10.

The front and back panels 12 and 14 may be in the form of rectangles as shown and the outer surface 22 of the front panel 12 may be provided with artwork and/or lettering as is conventional with greeting cards, consistent with the purpose or theme of the card. In contrast, the inside surface 24 of the front panel 12 may be blank, although in some cases it may be desirable to include artwork and/or lettering on this surface as well.

In the depicted embodiment, the back panel 14 contains an opening 26 arranged in its approximate center. The opening extends through the panel 14 from its inside to its outside surfaces 28 and 30 thereof, respectively. Accordingly, light is freely transmitted through the opening 26.

The shape of the opening 26 corresponds to an image which is selected because of its association or relationship with the purpose or theme of the card. For example, where the theme of the card is bereavement for loss of a loved one, the opening 26 may be in the shape of a cross as illustrated or some other appropriate religious symbol.

The middle or interior panel 16 of the card 10 of FIG. 1 is joined to the front and back panels along a side edge 32 adjacent the fold line 20 between the front and back panels. Accordingly, the opposite side edge 33 of the interior panel 16 is unconnected. The joining of the middle panel 16 to the front and back panels 12 and 14 may be accomplished by gluing, bonding, or other suitable method. The middle panel 16 may be of a shape and size corresponding substantially to that of the front and back panels 12 and 14.

The middle panel 16 is provided by a material that is translucent to the transmission of light and carries indicia such as a message 34 that is visible from a front surface 36 thereof. For example, the indicia 34 may be printed on the front surface 36 in the case in which the panel 16 is provided by a printable material such as paper, and the back surface 37 of the panel 16 may be blank. As used herein, the term "translucent" is intended to distinguish from "opaque" at one extreme and "transparent" at the other extreme. That is, the material of the panel 16 is such that it does not substantially completely block the transmission of light therethrough, but also is such that light does not transmit through the material substantially undisturbed. In other words, the material is something between clear and totally obscuring, and is such that the image defined on the back panel 14 is relatively indistinctly visible through the middle panel 16 when the middle panel 16 is disposed closely adjacent to the back panel 14 in an overlay fashion. For example, as shown in FIG. 1, a relatively faint or indistinct outline 38 of the image defined by passage of light through the opening 26 is visible from the front surface 36 of the middle panel 16.

The overall effect of viewing the relatively indistinct outline 38 in conjunction with the message 34 on the middle panel 16 is to enhance and supplement the experience associated with reading the message. Typically, for example, the outline 38 would represent a symbol having a connotation that is associated with the theme of the message 34 and the gentle or diffused form of the outline 38 of the image as a background for the message 34 enhances the experience of the reader.

In order to provide an appropriate translucent material for the middle panel 16, it is preferred to use a grade and style of paper that will result in the appearance of the outline 38 on the front surface 36 of the middle panel 16 so as to accomplish the above-described desired effect. The paper preferably should also readily accept printing or other surface treatments as may be used to provide the indicia or message 34. Exemplary of such papers are the 17 or 36 pound translucent paper sold under the trademark U.V. ULTRA II LAYER 16 by the Neenah Paper Co. of Neenah, Wis. or the 30 pound patapar parchment-type paper sold under the trademark CURTIS PARCHMENT by James River Co. of South Hampton, Pa., to name a few. Although a paper product is preferred, synthetic or other non-cellulosic materials may also be used. The material may be colored and/or contain designs and the like.

Figure 2:
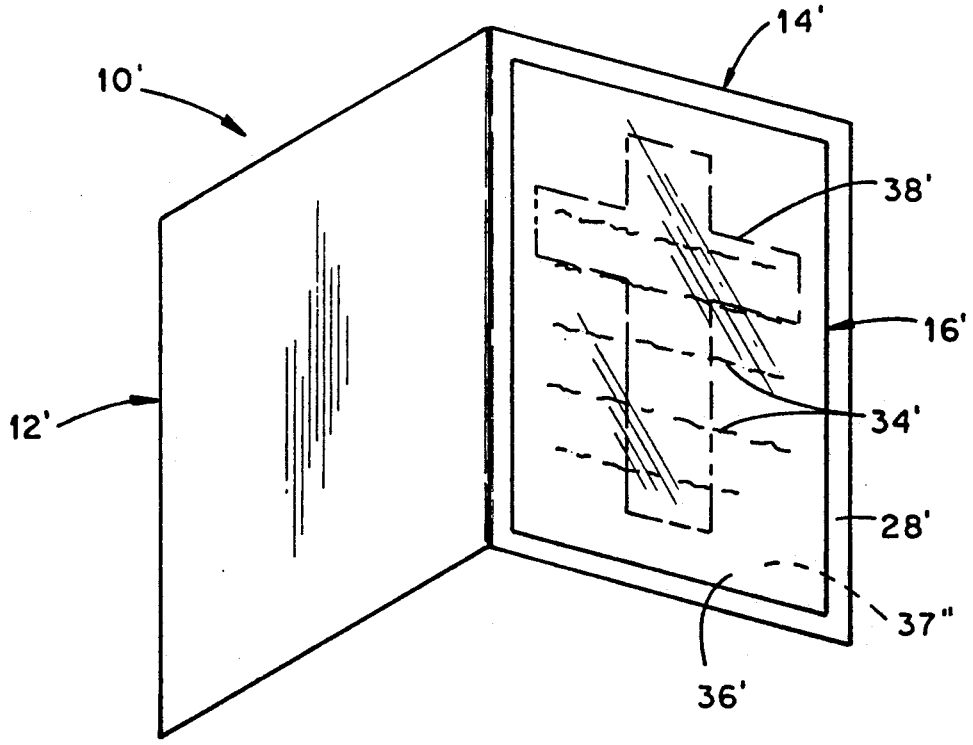
FIG. 2 is a perspective view illustrating the features of another the greeting card of the invention.

An alternate embodiment of the card 10' is shown in FIG. 2 and portions that correspond substantially to those of FIG. 1 are referred to and indicated with a prime suffix. In the embodiment of FIG. 2, the middle panel 16' is attached to the front surface 28' of the back panel 14'. The middle panel 16' may also have a somewhat reduced perimetal dimension as compared to the back panel 14' and may be centered relative to the back panel 14'. The material of construction of the middle panel 16' may be the same as that of card 10' of FIG. 1 and the panels 12' and 14' may be the same as well.

In the embodiment of FIG. 2, the middle panel 16' is fixedly disposed over and closely adjacent to the back panel 14' and substantially the same effect is achieved by the appearance of the outline 38' on the front surface 36' of the panel 16'. In effect, the card 10' of the embodiment of FIG. 2 employs the middle and back panels 16' and 14' essentially as a single panel, wherein the image is formed on the back surface 37'' of the middle panel 16' and is visible as the relatively indistinct outline 38' of the front surface 36' in conjunction with the message 34'.

Figure 3:
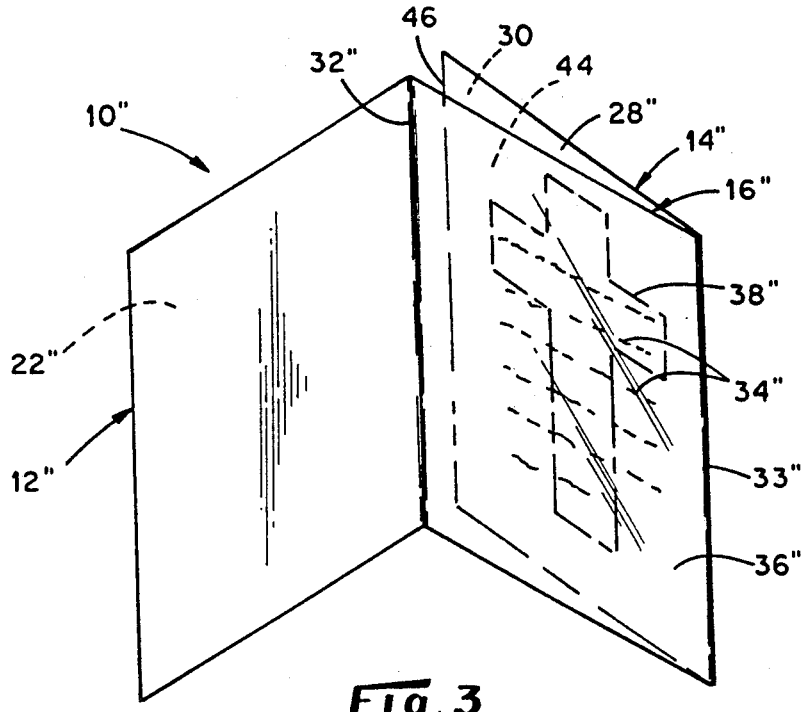
FIG. 3 is a perspective view illustrating the features of still another embodiment of the greeting card of the invention.
Figure 4:
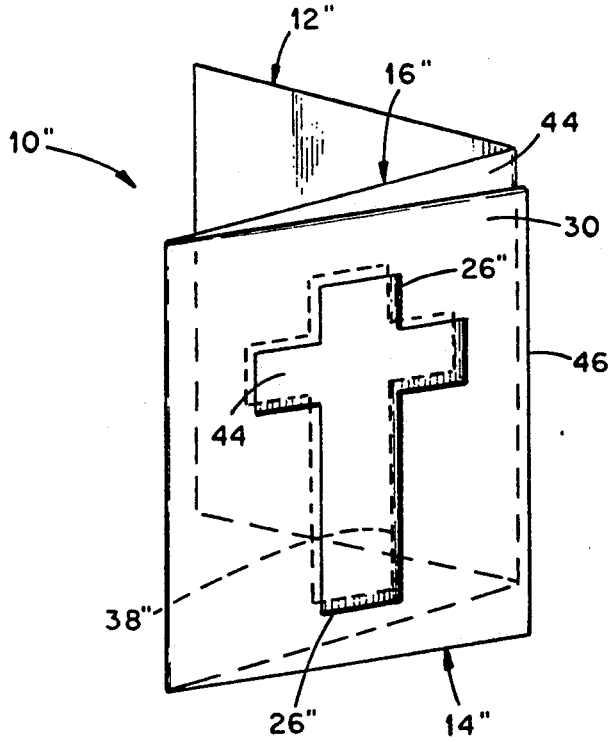
FIG. 4 is a perspective view illustrating the back of the card of FIG. 3.

A further embodiment of the invention is illustrated in FIGS. 3 and 4 and, as in the embodiment of FIG. 2, parts that correspond substantially to those of FIG. 1 are referred to and indicated with a prime suffix. The greeting card 10'' of FIGS. 3 and 4 contains a front panel 12'', a rear panel 14'', and a middle panel 16''. However, in this embodiment, the middle panel 16'' is attached along one of its side edges 33'' to the back panel 14'' and is attached along its other side edge 32'' to the front panel 12''. The attachment is such that the front panel 12'' folds over onto the front surface 36'' of the middle panel 16'' and the back panel 14'' folds over onto a back surface 44 of the middle panel 16'' but from an opposite side edge of the middle panel 16'' from that of the front panel 12''. In this manner, the card 10'' may be constructed as a continuous sheet which is folded at approximately one-third length intervals across its width to provide the edges 32'' and 33''. It will be appreciated that the translucent material forming the middle panel 16'' may also be used to provide the front panel 12'' and rear panel 14'', in which case it is preferred that the material be of such a character as to substantially prevent the image that is viewable from the front surface 36'' of the middle panel 16'' from being viewable from the front surface 22'' of the front panel 12''. Or, the middle panel 16'' and the back panel 14'' may be provided by the translucent material and the front panel 12'' provided by a substantially opaque material.

In addition, with respect to the embodiment of FIGS. 3 and 4, the back panel 14'' may be joined to the middle panel 16'' along an outboard side edge 46 of the back panel 14'' so that the middle panel 16'' is fixedly disposed closely adjacent to the back panel 14''. Also, the image that is defined on the front surface 28'' of the back panel 14'' for being viewed from the surface 36'' of the middle panel 16'' may be produced by the cutout 26'' or, alternately, may be provided by coloring applied to the surface 28'' in a shape or configuration to provide the desired image.

Although several embodiments of the present invention have been described in the foregoing detailed description, it will be understood that the invention is capable of numerous rearrangements, modifications, substitutions, and changes without departing from the scope and spirit of the invention as set forth in the appended claims. For example, the features of the various embodiments may be interchanged or arranged in ways not shown or described in the specification, which is provided for purposes of illustration only and not for purposes of limitation.

What is claimed is:

1. A greeting card comprising first panel means which is translucent to the transmission of light therethrough and having thematic indicia thereon, and second panel means substantially opaque to the transmission of light and connected to said first panel means, said second panel means having an opening therein which permits the transmission of light therethrough, the opening forming an image on the second panel means which is associated with the theme of the indicia, the translucency of said first panel means and its arrangement relative to said second panel means being such that upon disposition of said second first panel means closely adjacent to said second panel means in an overlay fashion, the image defined on said second panel means is relatively indistinctly visible through said first panel means to provide a diffused outline of the image on said first panel means as a background for the indicia on said first panel means to supplement and enhance the experience associated with viewing the indicia.

2. The card of claim 1, wherein all of the second panel means is translucent.

3. The card of claim 2, wherein said first panel means connects said second panel means to said third panel means and wherein the connection between said first, second, and third panel means includes means for allowing the third and second panel means to be folded onto opposite surfaces of said first panel means from opposed side edges of said first panel means.

4. The card of claim 1, wherein said first panel means fixedly overlays said second panel means.

5. A greeting card comprising first panel means which is translucent to the transmission of light therethrough and having thematic indicia thereon; a second panel means substantially opaque to the transmission of light and connected to said first panel means, said second panel means having an opening therein which permits the transmission of light therethrough, the opening forming an image on the second panel means which is associated with the theme of the indicia, the translucency of said first panel means and its arrangement relative to said second panel means being such that upon disposition of said first panel means closely adjacent to said second panel means in an overlay fashion, the image defined on said second panel means is relatively indistinctly visible through said first panel means to provide a diffused outline of the image on said first panel means as a background for the indicia on said first panel means to supplement and enhance the experience associated with viewing the indicia; and a third panel means having means for connecting the third panel means to the first panel means and for enabling said third panel means to be folded over so as to cover said first panel means and being provided by substantially opaque material such that said first panel means is substantially hidden from view when said third panel means is folded over thereon.

6. A greeting card comprising first panel means which is translucent to the transmission of light therethrough and having thematic indicia thereon; a translucent second panel means substantially opaque to the transmission of light and connected to said first panel means, said second panel means having an opening therein, which permits the transmission of light therethrough, the opening forming an image on the second panel means which is associated with the theme of the indicia, the translucency of said first panel means and its arrangement relative to said second panel means being such that upon disposition of said first panel means closely adjacent to said second panel means in an overlay fashion, the image defined on said second panel means is relatively indistinctly visible through said first panel means to provide a diffused outline of the image on said first panel means as a background for the indicia on said first panel means to supplement and enhance the experience associated with viewing the indicia; and a third panel means connected to said second panel means by said first panel means, wherein the connection between said first, second, and third panel means includes means for allowing the third and second panel means to be folded onto opposite surfaces of said first panel means from opposed side edges of said first panel means.

* * * * *

UNITED STATES PATENT AND TRADEMARK OFFICE

CERTIFICATE OF CORRECTION

PATENT NO. : Revonna L. Bean

DATED : 5,117,569

INVENTOR(S) : June 2, 1992

It is certified that error appears in the above-identified patent and that said Letters Patent is hereby corrected as shown below:

Column 1, line 5, after "and" insert --more--.

Column 2, line 24, after "another", insert --embodiment of--.

Column 4, line 4, delete "10'", and substitute --10-- therefor.

Column 5, line 12, delete "second".

Column 5, line 19, after "indicia", insert --; and a third panel means having means for connecting the third panel means to the first panel means and for enabling said third panel means to be disposed over said second panel means--.

Column 6, line 21, after "therein", delete ",".

Signed and Sealed this

Seventeenth Day of August, 1993

Bruce Lehman

*Attest:*

BRUCE LEHMAN

*Attesting Officer*

*Commissioner of Patents and Trademarks*